US009978301B2

(12) United States Patent
Hwang et al.

(10) Patent No.: US 9,978,301 B2
(45) Date of Patent: May 22, 2018

(54) DISPLAY APPARATUS

(71) Applicant: SAMSUNG DISPLAY CO., LTD., Yongin-si, Gyeonggi-do (KR)

(72) Inventors: Hyunsik Hwang, Hwaseong-si (KR); Bongim Park, Hwaseong-si (KR); Ikhyun Ahn, Hwaseong-si (KR); Yoongu Kim, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 9 days.

(21) Appl. No.: 15/238,544

(22) Filed: Aug. 16, 2016

(65) Prior Publication Data

US 2017/0186353 A1 Jun. 29, 2017

(30) Foreign Application Priority Data

Dec. 28, 2015 (KR) ..... 10-2015-0187733

(51) Int. Cl.
*G09G 3/20* (2006.01)
*G09G 3/36* (2006.01)

(52) U.S. Cl.
CPC ..... *G09G 3/2003* (2013.01); *G09G 3/3611* (2013.01); *G09G 3/3614* (2013.01); *G09G 3/3648* (2013.01); *G09G 2300/0426* (2013.01); *G09G 2300/0452* (2013.01); *G09G 2320/0209* (2013.01); *G09G 2320/0233* (2013.01); *G09G 2320/0242* (2013.01)

(58) Field of Classification Search
CPC ..... G09G 3/3614; G09G 2300/0426; G09G 3/3648; G09G 2300/0452; G09G 3/3607; G09G 2320/0233; G09G 2320/0209; G09G 2320/0242; G09G 2300/0439; G09G 2300/0443; G09G 2300/0465; G09G 3/2003
USPC ..... 345/690, 87, 695, 88, 89, 92
See application file for complete search history.

(56) References Cited

U.S. PATENT DOCUMENTS 8,724,067 B2 * 5/2014 Su ..... G02F 1/136286 349/139
2011/0242065 A1 * 10/2011 Hsu ..... G09G 3/006 345/204
2014/0125647 A1 * 5/2014 Shin ..... G09G 3/3648 345/212
2016/0314736 A1 * 10/2016 Sang ..... G09G 3/3607

FOREIGN PATENT DOCUMENTS

KR 10-2010-0035125 A 4/2010
KR 10-2011-0107659 A 10/2011
KR 10-2013-0067923 A 6/2013
KR 10-2014-0058252 A 5/2014

* cited by examiner

*Primary Examiner* — Koosha Sharifi-Tafreshi
(74) *Attorney, Agent, or Firm* — Lewis Roca Rothgerber Christie LLP

(57) ABSTRACT

A display apparatus includes pixels connected to gate lines and data lines. Among the pixels arranged in k-th and (k+1)th columns between j-th and (j+1)th data lines, the pixels arranged in the k-th column are connected to one data line of the j-th and (j+1)th data lines, the pixels arranged in the (k+1)th column are connected to the other data line of the j-th and (j+1)th data lines, and the pixels arranged in the k-th and (k+1)th columns are alternately connected to the j-th and (j+1)th data lines in a unit of two pixels.

18 Claims, 8 Drawing Sheets

DISPLAY APPARATUS

CROSS-REFERENCE TO RELATED APPLICATION

This U.S. non-provisional patent application claims priority to, and the benefit of, Korean Patent Application No. 10-2015-0187733, filed on Dec. 28, 2015, in the Korean Intellectual Property Office, the content of which is hereby incorporated by reference in its entirety.

BACKGROUND

1. Field of Disclosure

The present disclosure relates to a display apparatus having improved display quality.

2. Description of the Related Art

In general, a display apparatus shows colors using three primary colors of red, green, and blue. Accordingly, the display apparatus includes pixels respectively corresponding to the red, green, and blue colors.

In recent years, a display apparatus that shows the colors using red, green, blue, and/or other primary colors has been developed. These other primary colors include cyan, magenta, yellow, and/or white colors. In addition, to improve brightness of images, a display apparatus including red, green, blue, and white pixels has been developed. The display apparatus receives red, green, and blue image signals and converts the red, green, and blue signals to red, green, blue, and white data signals.

The converted red, green, blue, and white data signals are respectively applied to the red, green, blue, and white pixels. As a result, images are displayed by the red, green, blue, and white pixels.

SUMMARY

Aspects of the present disclosure are directed toward a display apparatus capable of improving a horizontal cross-talk phenomenon and a moving line-stain phenomenon to improve the display quality.

According to some embodiments of the inventive concept, there is provided a display apparatus including: a plurality of gate lines extending along a first direction; a plurality of data lines extending along a second direction crossing the first direction; and a plurality of pixels connected to the plurality of gate lines and the plurality of data lines, wherein, among pixels of the plurality of pixels arranged in a k-th column and a (k+1)th column between a j-th data line of the plurality of data lines and a (j+1)th data line of the plurality of data lines, the pixels arranged in the k-th column are connected to one of the j-th and (j+1)th data lines, the pixels arranged in the (k+1)th column are connected to an other one of the j-th and (j+1)th data lines, the pixels arranged in the k-th and (k+1)th columns are alternately connected to the j-th and (j+1)th data lines in a unit of two pixels, each of j and k is a natural number, a connection configuration between the (j+1)th data line and (j+2)th data line of the plurality of data lines and pixels of the plurality of pixels arranged in (k+2)th and (k+3)th columns between the (j+1)th and (j+2)th data lines is substantially the same as a connection configuration between pixels of the plurality of pixels arranged in the k-th and (k+1)th columns and the j-th and (j+1)th data lines, and a connection configuration between the (j+2)th data line and (j+3)th data line of the data lines and pixels of the plurality of pixels arranged in (k+4)th and (k+5)th columns between the (j+2)th and (j+3)th data lines and a connection configuration between the (j+3)th data line and (j+4)th data line of the data lines and pixels of the plurality of pixels arranged in (k+6)th and (k+7)th columns between the (j+3)th and (j+4)th data lines is opposite to a connection configuration between the pixels arranged in the k-th and (k+1)th columns and the j-th and (j+1)th data lines.

In an embodiment, among pixels of the plurality of pixels arranged in the k-th column, pixels of the plurality of pixels arranged in h-th and (h+1)th rows are connected to the j-th data line, and pixels of the plurality of pixels arranged in (h+2)th and (h+3)th rows are connected to the (j+1)th data line, h being a natural number, and wherein among the pixels arranged in the (k+1)th column, pixels of the plurality of pixels arranged in the h-th and (h+1)th rows are connected to the (j+1)th data line, and pixels of the plurality of pixels arranged in the (h+2)th and (h+3)th rows are connected to the j-th data line.

In an embodiment, the pixels are between odd- and even-numbered gate lines of the plurality of gate lines adjacent to each other in a unit of one row, pixels of the plurality of pixels arranged in a same row are alternately connected to the odd- and even-numbered gate lines in the unit of 8×I pixels, and I is a natural number.

In an embodiment, a connection configuration between i-th and (i+1)th gate lines of the plurality of gate lines and pixels of the plurality of pixels arranged in a h-th row between the i-th and (i+1)th gate lines is substantially the same as a connection configuration between (i+2)th and (i+3)th gate lines of the plurality of gate lines and pixels of the plurality of pixels arranged in a (h+1)th row between the (i+2)th and (i+3)th gate lines, and each of h and i is a natural number.

In an embodiment, earlier eight pixels arranged in the h-th row are sequentially connected to the (i+1)th, i-th, (i+1)th, (i+1)th, (i+1)th, i-th, (i+1)th, and i-th gate lines.

In an embodiment, a connection configuration between (i+4)th and (i+5)th gate lines of the plurality of gate lines and pixels of the plurality of pixels arranged in a (h+2)th row between the (i+4)th and (i+5)th gate lines is substantially the same as a connection configuration between (i+6)th and (i+7)th gate lines of the plurality of gate lines and pixels of the plurality of pixels arranged in a (h+3)th row between the (i+6)th and (i+7)th gate lines.

In an embodiment, earlier eight pixels arranged in the (h+2)th row are sequentially connected to the (i+5)th, (i+4)th, (i+5)th, (i+4)th, (i+4)th, (i+5)th, (i+4)th, and (i+4)th gate lines.

In an embodiment, a positive data voltage and a negative data voltage are alternately applied to the plurality of data lines during one frame period, and polarities of the data voltages are inverted every frame period.

In an embodiment, the plurality of pixels include: a plurality of first pixel groups, each of the plurality of first pixel groups including a first color pixel and a second color pixel; and a plurality of second pixel groups, each of the plurality of second pixel groups including a third color pixel and a fourth color pixel, and the first pixel groups are alternately arranged with the second pixel groups in the first and second directions.

In an embodiment, the first and second pixel groups arranged in the second direction are between ones of the plurality of data lines adjacent to each other.

In an embodiment, the first and second color pixels and the third and fourth color pixels are arranged in the first direction.

In an embodiment, the first, second, third, and fourth colors include red, green, blue, and white colors, respectively.

In an embodiment, the first, second, third, and fourth colors include blue, white, red, and green colors, respectively.

In an embodiment, the first direction includes an upper direction and a lower direction, the second direction includes a left direction and a right direction, and the pixels include: a plurality of first color pixel diagonal groups, each of the plurality of first color pixel diagonal groups including first color pixels arranged adjacent to each other in a first diagonal direction passing through an intersection of the first and second directions and passing between the upper direction of the first direction and the right direction of the second direction and between the lower direction of the first direction and the left direction of the second direction; a plurality of second color pixel diagonal groups, each of the plurality of second color pixel diagonal groups including second color pixels arranged adjacent to each other in the first diagonal direction; a plurality of third color pixel diagonal groups, each of the plurality of third color pixel diagonal groups including third color pixels arranged adjacent to each other in a second diagonal direction passing through the intersection of the first and second directions and passing between the upper direction of the first direction and the left direction of the second direction and between the lower direction of the first direction and the right direction of the second direction; and a plurality of fourth color pixel diagonal groups, each of the plurality of fourth color pixel diagonal groups including fourth color pixels arranged adjacent to each other in the second diagonal direction.

In an embodiment, the first color pixels of each of the first color pixel diagonal groups are configured to receive data voltages having the same polarity, the second color pixels of each of the second color pixel diagonal groups are configured to receive the data voltages having the same polarity, the third color pixels of each of the third color pixel diagonal groups are configured to receive the data voltages having the same polarity, and the fourth color pixels of each of the fourth color pixel diagonal groups are configured to receive the data voltages having the same polarity.

In an embodiment, the first and second color pixel diagonal groups adjacent to each other are configured to receive data voltages having opposite polarities to each other.

In an embodiment, the third and fourth color pixel diagonal groups adjacent to each other are configured to receive data voltages having opposite polarities to each other.

In an embodiment, the first color pixels adjacent to each other are configured to receive data voltages having opposite polarities to each other, the second color pixels adjacent to each other are configured to receive the data voltages having opposite polarities to each other, the third color pixels adjacent to each other are configured to receive the data voltages having opposite polarities to each other, and the fourth color pixels adjacent to each other are configured to receive the data voltages having opposite polarities to each other.

According to some embodiments of the inventive concept, there is provided a display apparatus including: a plurality of gate lines extending along a first direction; a plurality of data lines extending along a second direction crossing the first direction; and a plurality of pixels connected to the plurality of gate lines and the plurality of data lines, wherein pixels of the plurality of pixels arranged in a k-th column and a (k+1)th column between a j-th data line of the plurality of data lines and a (j+1)th data line of the plurality of data lines are connected to the j-th data line, each of j and k is a natural number, among the pixels arranged in a h-th row between a g-th gate line of the plurality of gate lines and a (g+1)th gate line of the plurality of gate lines, the pixels arranged in the k-th column are connected to the g-th gate line, the pixels arranged in the (k+1)th column are connected to the (g+1)th gat line, h is a natural number, g is an odd number among natural numbers, a polarity of data voltages applied to the data lines is inverted every two rows during one frame period, and data voltages of the polarity of data voltages applied to the pixels arranged in the h-th row is inverted every two data lines.

According to some embodiments of the inventive concept, there is provided a display apparatus including: a plurality of gate lines extending along a first direction; a plurality of data lines extending along a second direction crossing the first direction; and a plurality of pixels connected to the plurality of gate lines and the plurality of data lines, wherein a j-th data line of the plurality of data lines is between pixels of the plurality of pixels arranged in an f-th column and pixels plurality of pixels arranged in a (f+1)th column, the pixels arranged in the f-th and (f+1)th columns are connected to the j-th data line, j is a natural number, f is an odd number among natural numbers, among pixels of the plurality of pixels arranged in an h-th row between a g-th gate line of the plurality of gate lines and a (g+1)th gate line of the plurality of gate lines, the pixels arranged in the f-th column are connected to the g-th gate line, the pixels arranged in the (f+1)th column are connected to the (g+1)th gat line, h is a natural number, g is an odd number among the natural numbers, polarities of data voltages applied to the plurality of data lines are inverted every two rows during one frame period, and polarities of data voltages applied to the pixels arranged in the h-th row are inverted every two data lines.

According to the above embodiments, the display apparatus prevents or substantially prevents the horizontal cross-talk phenomenon and/or the moving line-stain phenomenon from occurring, and thus the display quality of the display apparatus may be improved.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in further detail with reference to the accompanying drawings.

Figure 1:
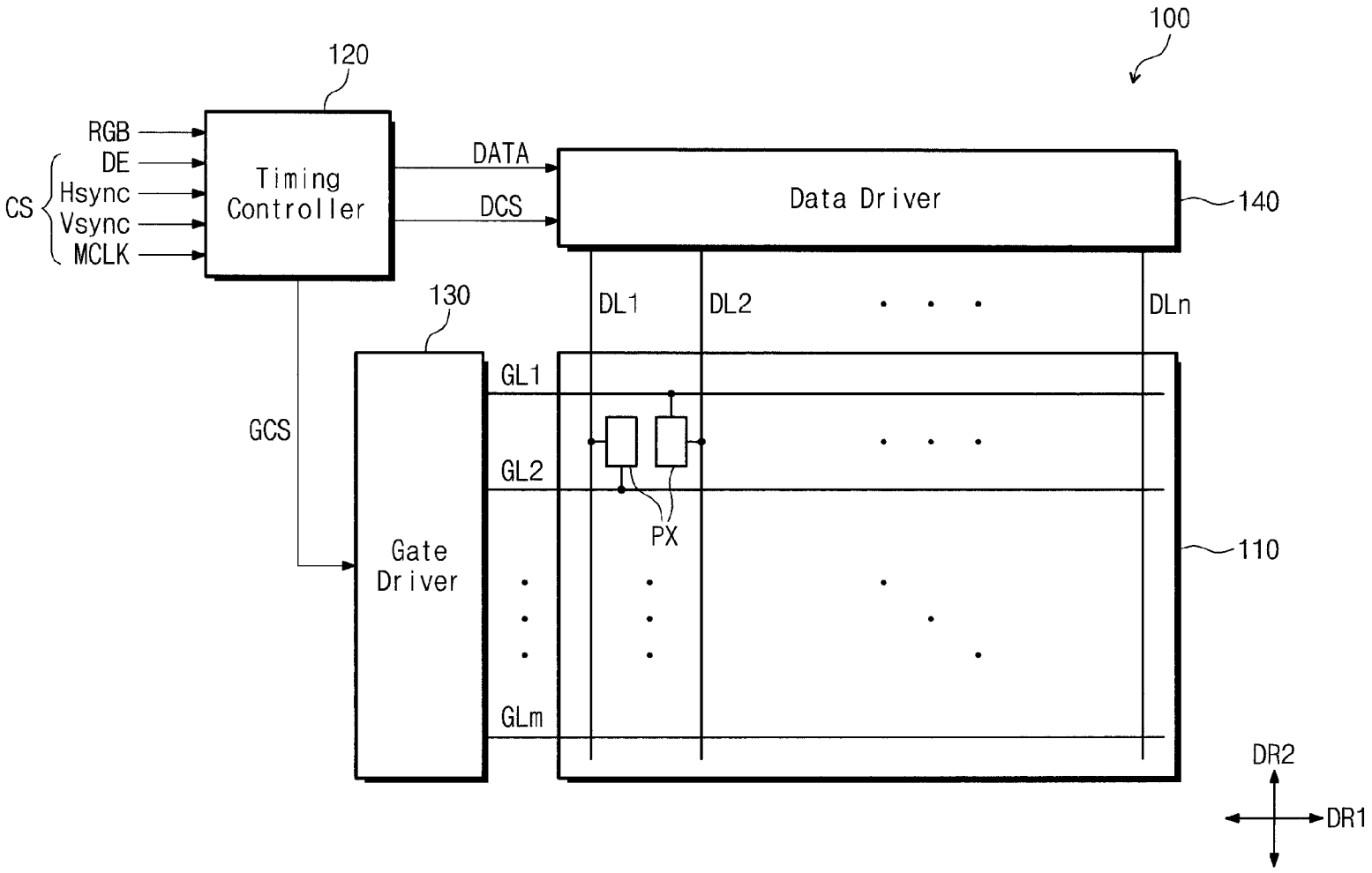
FIG. 1 is a block diagram showing a display apparatus according to an exemplary embodiment of the present disclosure.

FIG. 1 is a block diagram showing a display apparatus 100 according to an exemplary embodiment of the present disclosure.

Referring to FIG. 1, the display apparatus 100 includes a display panel 110, a timing controller 120, a gate driver 130, and a data driver 140.

The display panel 110 may be, but not limited to, a liquid crystal display panel configured to include two substrates facing each other and a liquid crystal layer interposed between the two substrates. The display panel 110 includes a plurality of gate lines GL1 to GLm, a plurality of data lines DL1 to DLn, and a plurality of pixels PX. Each of "m" and "n" is a natural number.

The gate lines GL1 to GLm extend along a first direction DR1 and are connected to the gate driver 130. The data lines DL1 to DLn extend along a second direction DR2 crossing the first direction DR1 and are connected to the data driver 140. The first direction DR1 corresponds to a row direction, and the second direction DR2 corresponds to a column direction.

FIG. 1 shows two pixels PX as a representative example, but the number of the pixels PX should not be limited to two. That is, a plurality of pixels PX is arranged in a matrix form and connected to the gate lines GL1 to GLm and the data lines DL1 to DLn. The connection between the pixels PX and the gate and data lines GL1 to GLm and DL1 to DLn will be described in further detail with reference to FIG. 3.

Each pixel PX displays one primary color. The primary colors include red, green, blue, and white, but the primary colors may further include yellow, cyan, and/or magenta.

The timing controller 120 receives image signals RGB and control signals CS from an external source, for example, a system board. The image signals RGB include red image signals, green image signals, and blue image signals. The timing controller 120 generates the red, green, blue, and white images signals using the image signals RGB.

The timing controller 120 converts a data format of the red, green, blue, and white image signals to a data format appropriate to an interface between the timing controller 120 and the data driver 140. The timing controller 120 applies the red, green, blue, and white image signals having the converted data format to the data driver 140 as image data DATA.

The control signals CS include a vertical synchronization signal Vsync as a frame distinction signal, a horizontal synchronization signal Hsync as a row distinction signal, a data enable signal maintained DE at a high level during a period, in which data are output, to indicate a data input period, and a main clock signal MCLK.

The timing controller 120 generates a gate control signal GCS and a data control signal DCS in response to the control signals CS. The gate control signal GCS is used to control an operation timing of the gate driver 130, and the data control signal DCS is used to control an operation timing of the data driver 140. The timing controller 120 applies the gate control signal GCS to the gate driver 130 and applies the data control signal DCS to the data driver 140.

The gate control signal GCS includes a scan start signal for indicating a start of scanning, at least one clock signal for controlling an output period of a gate on voltage, and an output enable signal for controlling the maintaining of the gate on voltage.

The data control signal DCS includes a horizontal start signal for indicating a start of transmitting of the image data DATA to the data driver 140, a load signal for indicating application of data voltages to the data lines DL1 to DLn, and an inversion signal for inverting a polarity of the data voltages with respect to a common voltage.

The gate driver 130 generates gate signals in response to the gate control signal GCS. The gate signals are sequentially output and applied to the pixels PX through the gate lines GL1 to GLm.

The data driver 140 generates the data voltages in analog form, which correspond to the image data DATA, in response to the data control signal DCS. The data voltages are applied to the pixels PX through the data lines DL1 to DLn.

The polarity of the data voltages applied to each pixel PX is inverted every frame period to prevent or substantially prevent liquid crystals from burning or deteriorating. For instance, the data driver 140 inverts the polarity of the data voltages every frame period in response to the inversion signal.

In addition, when the image corresponding to one frame is displayed, the data voltages having different polarities are output in the unit of one or two data lines and applied to the data lines DL1 to DLn to improve display quality. This will be described in further detail with reference to FIGS. 4, 6, and 8.

The pixels PX receive the data voltages through the data lines DL1 to DLn in response to the gate signals applied thereto through the gate lines GL1 to GLm. The pixels PX display gray scale values corresponding to data voltages, and thus the image is displayed.

The timing controller 120 is mounted on a printed circuit board in an integrated circuit chip and connected to the gate driver 130 and the data driver 140. The gate driver 130 and the data driver 140 are integrated into plural driving chips, mounted on flexible printed circuit board, and connected to the display panel 110 utilizing a tape carrier package method, but they should not be limited thereto or thereby.

As another way, the timing controller 120, the gate driver 130, and the data driver 140 may be mounted on the display panel 110 in a chip-on-glass (COG) method after being integrated into at least one driving chip. The timing controller 120, the gate driver 130, and the data driver 140 may be integrated into a single chip. In addition, the gate driver 130 may be substantially simultaneously or concurrently formed with transistors of the pixels PX, and then mounted on the display panel 110 in an amorphous silicon TFT gate driver circuit (ASG) method or in an oxide silicon TFT gate driver circuit (OSG) method.

The display apparatus may include a backlight unit disposed (e.g., located or positioned) at a rear side of the display panel 110 to provide a light to the display panel 110.

Figure 2:
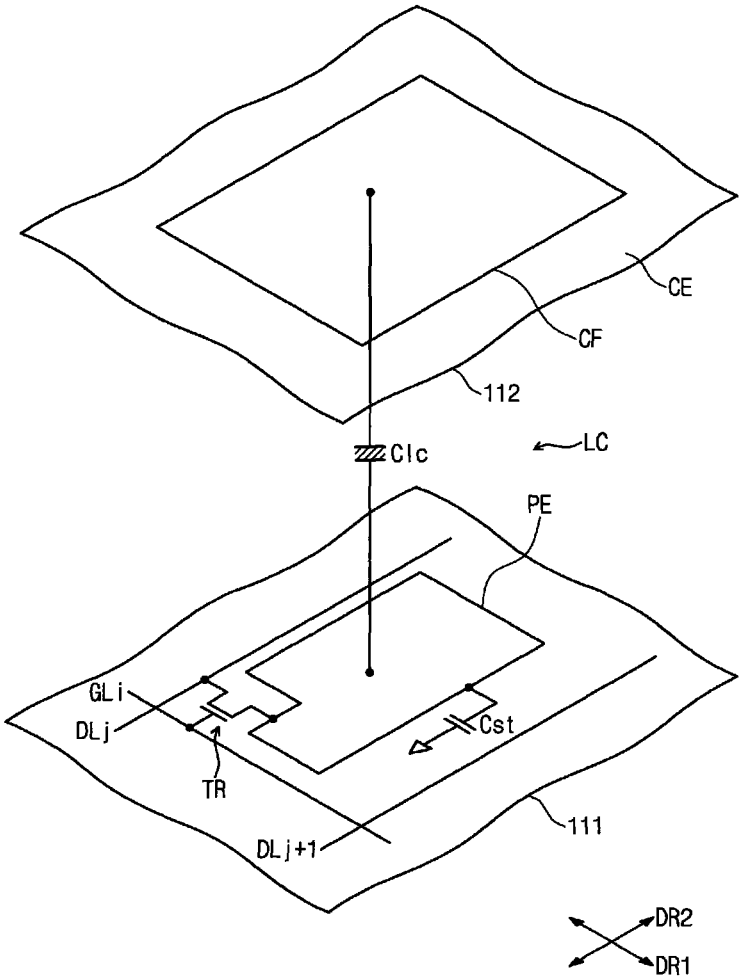
FIG. 2 is a circuit diagram showing a pixel shown in FIG. 1.

FIG. 2 is a circuit diagram showing a pixel shown in FIG. 1.

In the present exemplary embodiment, because the pixels PX have the same structure and function, and thus, for the convenience of explanation, FIG. 2 shows only the pixel PX connected to a gate line GLi and a data line DLj.

Referring to FIG. 2, the display panel 110 includes a first substrate 111, a second substrate 112 facing the first substrate 111, and a liquid crystal layer LC interposed between the first substrate 111 and the second substrate 112.

The pixel PX includes a transistor TR connected to the gate line GLi and the data line DLj, a liquid crystal capacitor Clc connected to the transistor TR, and a storage capacitor Cst connected to the liquid crystal capacitor Clc in parallel. The storage capacitor Cst may be omitted. In the present exemplary embodiment, "i" is a natural number greater than zero (0) and equal to or less than "m", and "j" is a natural number greater than zero (0) and equal to or less than "n".

The transistor TR is disposed on the first substrate 111. The transistor TR includes a gate electrode connected to the gate line GLi, a source electrode connected to the data line DLj, and a drain electrode connected to the liquid crystal capacitor Clc and the storage capacitor Cst.

The liquid crystal capacitor Clc is configured to include a pixel electrode PE disposed on the first substrate 111, a common electrode CE disposed on the second substrate 112, and the liquid crystal layer LC interposed between the pixel electrode PE and the common electrode CE. The liquid crystal layer LC serves as a dielectric substance. The pixel electrode PE is connected to the drain electrode of the transistor TR.

The pixel electrode PE shown in FIG. 2 does not have a slit structure, but the pixel PX may have the slit structure in which a trunk portion having a cross shape and a plurality of branch portions extending from the trunk portion in a radial shape are formed through the pixel PX.

The common electrode CE is disposed over (e.g., located or positioned over) an entire surface of the second substrate 112, but it should not be limited thereto or thereby. For example, the common electrode CE may be disposed on the first substrate 111 according to some embodiments. In this case, at least one of the pixel electrode PE and the common electrode CE may have the slit structure.

The storage capacitor Cst includes the pixel electrode PE, a storage electrode branched from a storage line, and an insulating layer disposed between (e.g., located or positioned between) the pixel electrode PE and the storage electrode. The storage line is disposed on the first substrate 111. The storage line is disposed on the same layer as the gate lines GL1 to GLm and substantially simultaneously or concurrently formed with the gate lines GL1 to GLm. The storage electrode may be partially overlapped with the pixel electrode PE.

The pixel PX may further include a color filter CF that represents one of the primary colors. The color filter CF is disposed on the second substrate 112 as shown in FIG. 2, but it should not be limited thereto or thereby. For example, the color filter CF may be disposed on the first substrate 111 instead of the second substrate 112.

The transistor TR is turned on in response to the gate signal applied thereto through the gate line GLi. The data voltage provided through the data line DLj is applied to the pixel electrode PE of the liquid crystal capacitor Clc through the turned-on transistor TR. The common electrode CE is applied with the common voltage.

Due to a difference in voltage level between the data voltage and the common voltage, an electric field is generated between the pixel electrode PE and the common electrode CE. Liquid crystal molecules of the liquid crystal layer LC are driven by the electric field generated between the pixel electrode PE and the common electrode CE. A transmittance of light incident to the liquid crystal layer LC is controlled by the liquid crystal molecules driven by the electric field, and thus the image is displayed.

The storage line is applied with a storage voltage having a constant voltage level, but it should not be limited thereto or thereby. For example, the storage line may be applied with the common voltage. The storage capacitor Cst compensates for the limited charging rate of the liquid crystal capacitor Clc.

Figure 3:
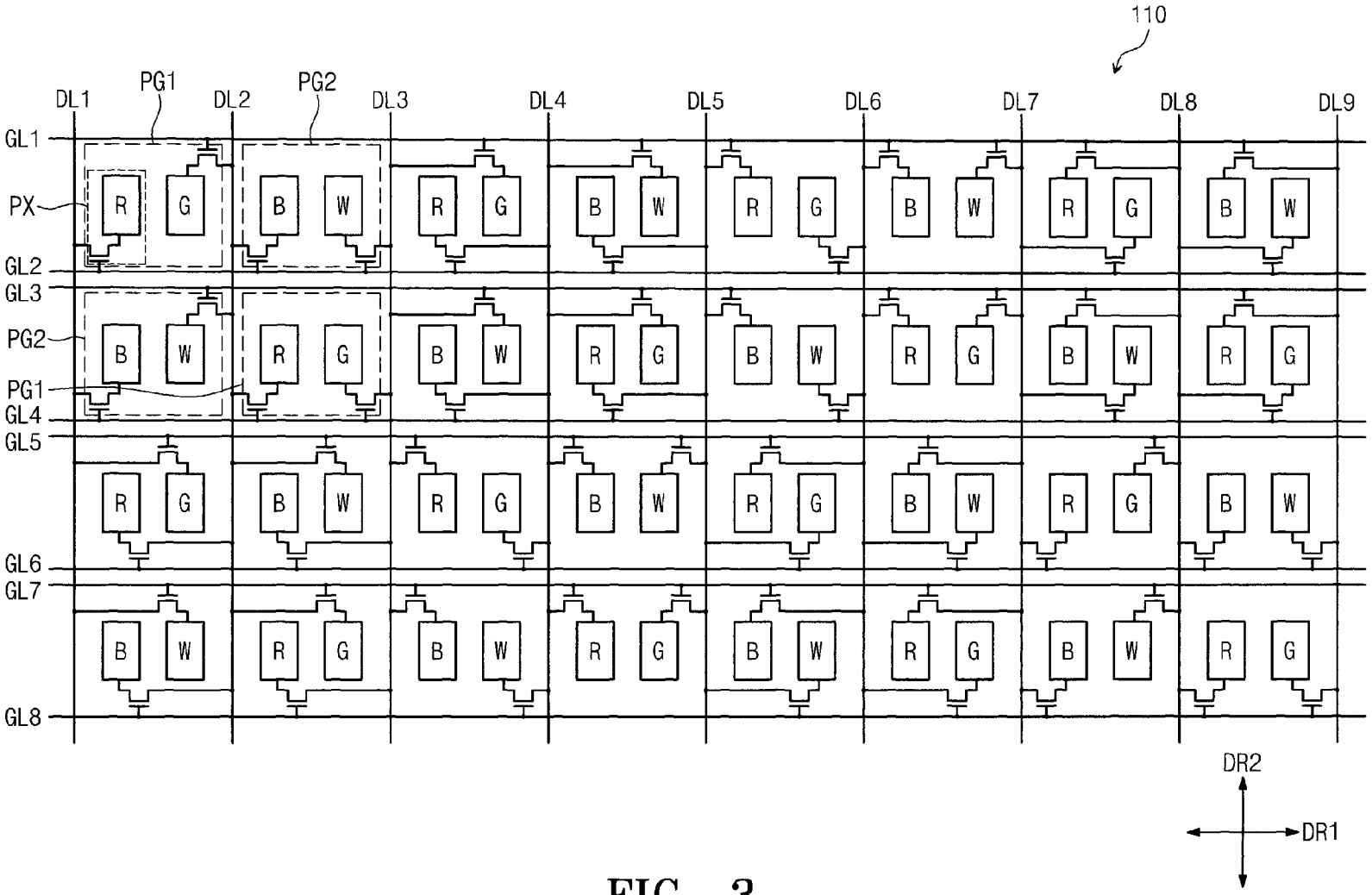
FIG. 3 is a plan view showing a portion of a display panel according to an exemplary embodiment of the present disclosure.

FIG. 3 is a plan view showing a portion of a display panel according to an exemplary embodiment of the present disclosure.

FIG. 3 shows first to eighth gate lines GL1 to GL8 and first to ninth data lines DL1 to DL9. In FIG. 3, for the convenience of explanation, a red pixel is indicated by R, a green pixel is indicated by G, a blue pixel is indicated by B, and a white pixel is indicated by W.

Referring to FIG. 3, the pixels PX are arranged in a matrix form and connected to the gate lines GL1 to GL8 and the data lines DL1 to DL9. The pixels PX include a plurality of first pixel groups PG1 each including a first color pixel and a second color pixel and a plurality of second pixel groups PG2 each including a third color pixel and a fourth color pixel.

First, second, third, and fourth colors may be red, green, blue, and white colors, respectively, but they should not be limited thereto or thereby. For example, the first to fourth colors may further include yellow, cyan, and/or magenta colors. The first and second color pixels and the third and fourth color pixels are arranged along a first direction DR1.

Hereinafter, the first color pixel, the second color pixel, the third color pixel, and the fourth color pixel are respectively referred to as the red pixel R, the green pixel G, the blue pixel B, and the white pixel W. A direction in which the row number increases is a direction from top to bottom in FIG. 3, and a direction in which the column number increases is a direction from left to right in FIG. 3.

The first pixel groups PG1 are alternately arranged with the second pixel groups PG2 in both the first and second directions DR1 and DR2. The pixels PX arranged in a h-th row are arranged in the same order as the pixels PX arranged in a (h+2)th row, and the pixels PX arranged in a (h+1)th row are arranged in the same order as the pixels PX arranged in a (h+3)th row.

For instance, in the case that the index "h" is 1, the pixels PX arranged in first and third rows are repeatedly arranged in the order of red, green, blue, and white pixels R, G, B, and W. The pixels PX arranged in second and fourth rows are repeatedly arranged in the order of blue, white, red, and green B, W, R, and G. In the present exemplary embodiment, the index "h" is a natural number.

The positions of the red and green pixels R and G may be changed with the positions of the blue and white pixels B and W. For instance, according to another embodiment, the pixels PX may be arranged in the h-th and (h+2)th rows in the order of green, red, blue, and white pixels G, R, B, and W, and the pixels PX may be arranged in the (h+1)th and (h+3)th rows in the order of blue, white, green, and red pixels B, W, G, and R.

According to another embodiment, the pixels PX may be arranged in the h-th and (h+2)th rows in the order of green, red, white, and blue pixels G, R, W, and B, and the pixels PX may be arranged in the (h+1)th and (h+3)th rows in the order of white, blue, green, and red pixels W, B, G, and R.

According to another embodiment, the pixels PX may be arranged in the h-th and (h+2)th rows in the order of red, green, white, and blue pixels R, G, W, and B, and the pixels PX may be arranged in the (h+1)th and (h+3)th rows in the order of white, blue, red, and green pixels W, B, R, and G.

The pixels PX are disposed between and connected to the data lines adjacent to each other in the unit of two columns (e.g., two pixels in a same row). The pixels arranged in the unit of two columns correspond to the first and second pixel groups PG1 and PG2 arranged in the first direction DR1. The pixels PX are disposed between an odd-numbered gate line and an even-numbered gate line, which are adjacent to each other, in the unit of one row, and are connected to odd- and even-numbered gate lines adjacent to each other.

Among the pixels PX arranged in k-th and (k+1)th columns disposed between j-th and (j+1)th data lines, the pixels PX arranged in the k-th column are connected to one data line of the j-th and (j+1)th data lines, and the pixels PX arranged in the (k+1)th column are connected to the other data line of the j-th and (j+1)th data lines. The pixels PX arranged in the k-th column and the pixels PX arranged in the (k+1)th data lines are alternately connected to the j-th and (j+1)th data lines in the unit of two pixels in the column direction. In the present exemplary embodiment, the index "k" is a natural number.

For instance, in the case that each of h, j, and k is 1, the pixels PX arranged in a first column and the pixels PX arranged in a second column are disposed between first and second data lines DL1 and DL2. Among the pixels PX arranged in the first column, the pixels PX arranged in the first and second rows are connected to the first data line DL1, and the pixels PX arranged in the third and fourth rows are connected to the second data line DL2. Among the pixels PX arranged in the second column, the pixels PX arranged in the first and second rows are connected to the second data line DL2, and the pixels PX arranged in the third and fourth rows are connected to the first data lines DL1.

The connection structure between (j+1)th and (j+2)th data lines and the pixels PX arranged in (k+2)th and (k+3)th columns disposed between the (j+1)th and (j+2)th data lines is substantially the same as the connection structure between the j-th and (j+1)th data lines and the pixels PX arranged in the k-th and (k+1)th columns.

For instance, in the case that each of h, j, and k is 1, the pixels PX arranged in a third column and the pixels PX arranged in a fourth column are disposed between second and third data lines DL2 and DL3. Among the pixels PX arranged in the third column, the pixels PX arranged in the first and second rows are connected to the second data line DL2, and the pixels PX arranged in the third and fourth rows are connected to the third data line DL3. Among the pixels PX arranged in the fourth column, the pixels PX arranged in the first and second rows are connected to the third data line DL3, and the pixels PX arranged in the third and fourth rows are connected to the second data lines DL2.

That is, among the pixels PX arranged in the first and third columns, two pixels PX in the column direction are connected to the data lines DL1 and DL2 disposed adjacent to a left side thereof, and the following two pixels PX in the column direction are connected to the data lines DL2 and DL3 disposed adjacent to a right side of the second and fourth columns. In addition, among the pixels PX arranged in the second and fourth columns, two pixels PX in the column direction are connected to the data lines DL2 and DL3 disposed adjacent to a right side thereof, and the following two pixels PX in the column direction are connected to the data lines DL1 and DL2 disposed adjacent to a left side the first and third columns.

The connection structure between (j+2)th and (j+3)th data lines and the pixels PX arranged in (k+4)th and (k+5)th columns disposed between the (j+2)th and (j+3)th data lines is opposite to the connection structure between the j-th and (j+1)th data lines and the pixels PX arranged in the k-th and (k+1)th columns.

For instance, in the case that each of h, j, and k is 1, the pixels PX arranged in a fifth column and the pixels PX arranged in a sixth column are disposed between third and fourth data lines DL3 and DL4. Among the pixels PX arranged in the fifth column, the pixels PX arranged in the first and second rows are connected to the fourth data line DL4, and the pixels PX arranged in the third and fourth rows are connected to the third data line DL3. Among the pixels PX arranged in the sixth column, the pixels PX arranged in the first and second rows are connected to the third data line DL3, and the pixels PX arranged in the third and fourth rows are connected to the fourth data line DL4.

That is, among the pixels PX arranged in the first column, two pixels PX in the column direction are connected to the data line DL1 disposed adjacent to a left side thereof, and the following two pixels PX in the column direction are connected to the data line DL2 disposed adjacent to a right side thereof. However, among the pixels PX arranged in the fifth column, two pixels PX in the column direction are connected to the data line DL4 disposed adjacent to a right side of the sixth column, and the following two pixels PX in the column direction are connected to the data line DL3 disposed adjacent to a left side thereof.

In addition, among the pixels PX arranged in the second column, two pixels PX in the column direction are connected to the data line DL2 disposed adjacent to a right side thereof, and the following two pixels PX in the column direction are connected to the data line DL1 disposed adjacent to a left side thereof. However, among the pixels PX arranged in the sixth column, two pixels PX in the column direction are connected to the data line DL3 disposed adjacent to a left side of the fifth column, and the following two pixels PX in the column direction are connected to the data line DL4 disposed adjacent to a right side thereof.

The connection structure between (j+3)th and (j+4)th data lines and the pixels PX arranged in (k+6)th and (k+7)th columns disposed between the (j+3)th and (j+4)th data lines is substantially the same as the connection structure between the (j+2)th and (j+3)th data lines and the pixels PX arranged in the (k+4)th and (k+5)th columns.

For instance, in the case that each of h, j, and k is 1, the pixels PX arranged in seventh and eighth columns are disposed between the fourth data line DL4 and the fifth data line DL5. Among the pixels arranged in the seventh column, the pixels PX arranged in the first and second rows are connected to the fifth data line DL5, and the pixels PX arranged in the third and fourth rows are connected to the fourth data line DL4. Among the pixels arranged in the eighth column, the pixels PX arranged in the first and second rows are connected to the fourth data line DL4, and the pixels PX arranged in the third and fourth rows are connected to the fifth data line DL5.

That is, among the pixels PX arranged in the fifth and seventh columns, two pixels PX in the column direction are connected to the data lines DL4 and DL5 disposed adjacent to a right side of the pixels PX arranged in the sixth and eighth columns, and the following two pixels PX are connected to the data lines DL3 and DL4 disposed adjacent to a left side thereof. In addition, among the pixels PX arranged in the sixth and eighth columns, two pixels PX in the column direction are connected to the data lines DL3 and DL4 disposed adjacent to a left side of the pixels PX arranged in the fifth and seventh columns, and the following two pixels PX are connected to the data lines DL4 and DL5 disposed adjacent to a right side thereof.

The pixels disposed between the odd- and even-numbered gate lines adjacent to each other are alternately connected to the odd- and even-numbered gate lines adjacent to each other in the unit of 8l (i.e., eight times the index l). The index "l" is a natural number.

The connection structure between i-th and (i+1)th gate lines and the pixels PX arranged in the h-th row disposed between the i-th and (i+1)th gate lines is substantially the same as the connection structure between (i+2)th and (i+3)th gate lines and the pixels PX arranged in the (h+1)th row disposed between the (i+2)th and (i+3)th gate lines.

The connection structure between (i+4)th and (i+5)th gate lines and the pixels PX arranged in the (h+2)th row disposed between the (i+4)th and (i+5)th gate lines is substantially the same as the connection structure between (i+6)th and (i+7)th gate lines and the pixels PX arranged in the (h+3)th row disposed between the (i+6)th and (i+7)th gate lines.

For example, in the case that each of h, l, and i is 1, among the pixels PX arranged in the first row disposed between the first and second gate lines GL1 and GL2, earlier eight pixels PX are sequentially connected to the second gate line GL2, the first gate line GL1, the second gate line GL2, the second gate line GL2, the second gate line GL2, the first gate line GL1, the second gate line GL2, and the first gate line GL1, and later eight pixels PX are sequentially connected to the first gate line GL1, the second gate line GL2, the first gate line GL1, the first gate line GL1, the first gate line GL1, the second gate line GL2, the first gate line GL1, and the second gate line GL2. That is, the earlier eight pixels PX in the first row have a connection configuration (with regard to their respective adjacent gate lines GL1 and GL2 that is) opposite to that of the later eight pixels PX in the first row.

Among the pixels PX arranged in the second row disposed between the third and fourth gate lines GL3 and GL4, earlier eight pixels PX are sequentially connected to the fourth gate line GL4, the third gate line GL3, the fourth gate line GL4, the fourth gate line GL4, the fourth gate line GL4, the third gate line GL3, the fourth gate line GL4, and the third gate line GL3, and later eight pixels PX are sequentially connected to the third gate line GL3, the fourth gate line GL4, the third gate line GL3, the third gate line GL3, the third gate line GL3, the fourth gate line GL4, the third gate line GL3, and the fourth gate line GL4. That is, the earlier eight pixels PX in the second row have a connection configuration (with regard to their respective adjacent gate lines GL3 and GL4 that is) opposite to that of the later eight pixels PX in the second row.

That is, the order in which the pixels PX arranged in the first row are connected to the gate lines respectively disposed above and below (e.g., at upper and lower portions of) the pixels PX arranged in the first row is substantially the same as the order in which the pixels PX arranged in the second row are connected to the gate lines respectively disposed above and below (e.g., at upper and lower portions of) the pixels PX arranged in the second row.

Among the pixels PX arranged in the third row disposed between the fifth and sixth gate lines GL5 and GL6, earlier eight pixels PX are sequentially connected to the sixth gate line GL6, the fifth gate line GL5, the sixth gate line GL6, the fifth gate line GL5, the fifth gate line GL5, the sixth gate line GL6, the fifth gate line GL5, and the fifth gate line GL5, and later eight pixels PX are sequentially connected to the fifth gate line GL5, the sixth gate line GL6, the fifth gate line GL5, the sixth gate line GL6, the sixth gate line GL6, the fifth gate line GL5, the sixth gate line GL6, and the sixth gate line GL6. That is, the earlier eight pixels PX in the third row have a connection configuration (with regard to their respective adjacent gate lines GL5 and GL6 that is) opposite to that of the later eight pixels PX in the third row.

That is, the order in which the pixels PX arranged in the fourth row disposed between seventh and eighth gate lines GL7 and GL8 are connected to the seventh and eighth gate lines GL7 and GL8 is substantially the same as the order in which the pixels PX arranged in the third row are connected to the fifth and sixth gate lines GL5 and GL6.

Figure 4:
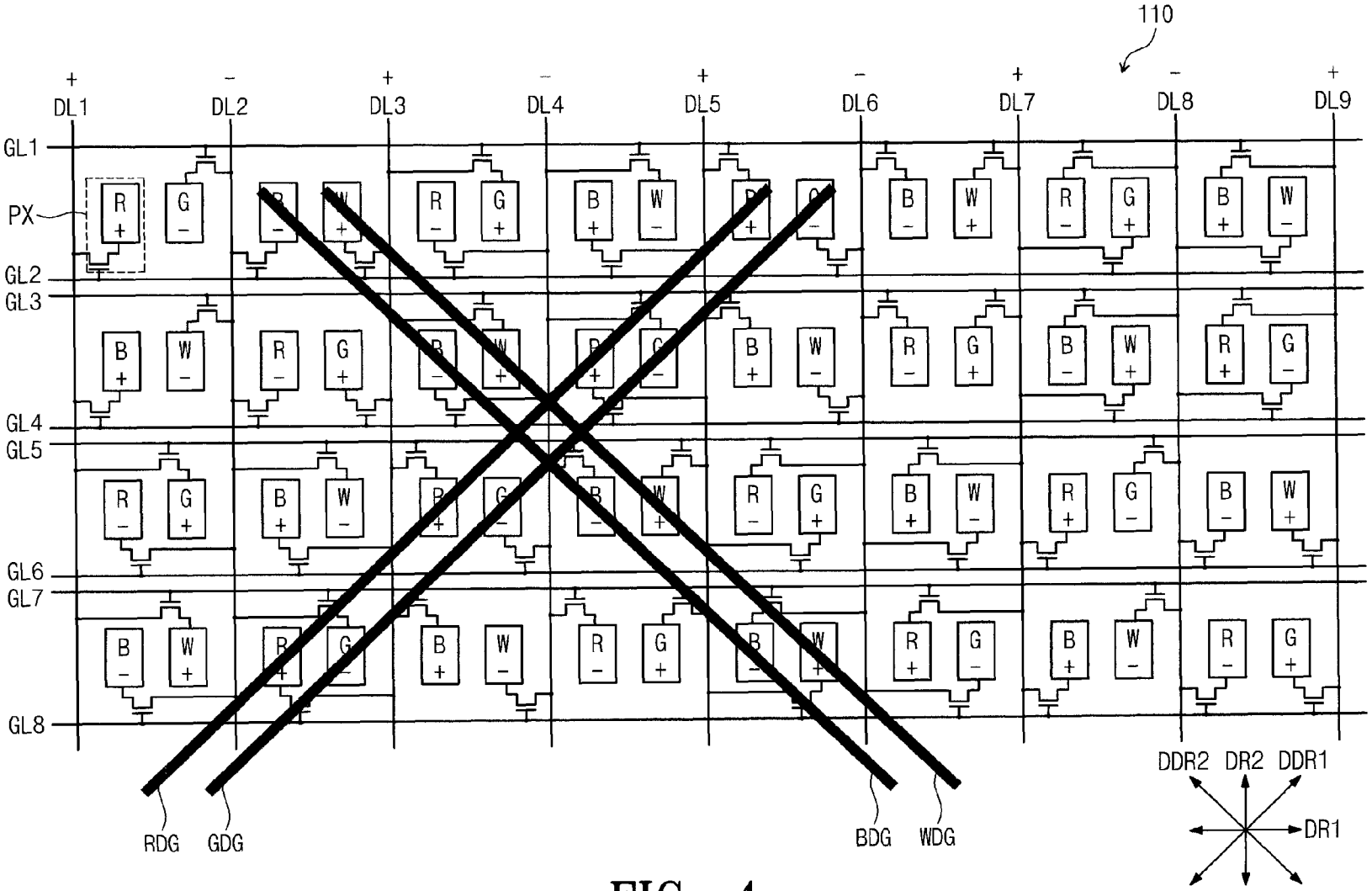
FIG. 4 is a view showing polarities of data voltages applied to data lines shown in FIG. 3 and polarities of pixels applied with the data voltages.

FIG. 4 is a view showing polarities of data voltages applied to data lines shown in FIG. 3 and polarities of pixels applied with the data voltages.

In FIG. 4, for the convenience of explanation, the pixels PX applied with a positive (+) polarity data voltage are represented by R+, G+, B+, and W+, and the pixels PX applied with a negative (−) polarity data voltage are represented by R−, G−, B−, and W−. In addition, the reference numerals, for example, PG1 and PG2, indicating the pixel groups are omitted in FIG. 4.

Referring to FIG. 4, the positive (+) data voltage and the negative (−) data voltage are alternately applied to the data lines DL1 to DL9 during one frame period. For instance, during a present (e.g., current) frame period, the first, third, fifth, seventh, and ninth data lines DL1, DL3, DLS, DL7, and DL9 are applied with the positive (+) data voltages, and second, fourth, sixth, and eighth data lines DL2, DL4, DL6, and DL8 are applied with the negative (−) data voltages. Accordingly, the polarity of the data voltage is inverted every data line.

The polarity of the data voltages may be inverted every frame period. For instance, during a next frame period, the first, third, fifth, seventh, and ninth data lines DL1, DL3, DL5, DL7, and DL9 may be applied with the negative (−) data voltages, and second, fourth, sixth, and eighth data lines DL2, DL4, DL6, and DL8 may be applied with the positive (+) data voltages.

The pixels PX receive the data voltages through the data lines DL1 to DL9 in response to the gate signals provided through the gate lines GL1 to GL8 and are charged with the data voltages as pixel voltages.

Each of the pixels PX arranged in the same row is alternately applied with the positive (+) data voltage and the negative (−) data voltage. For example, among the red pixels R arranged in the first row, odd-numbered red pixels R+ are applied with the positive (+) data voltages, and even-numbered red pixels R− are applied with the negative (−) data voltages.

In the case that the data voltages applied to the pixels arranged in the (h+1)th row have the same polarity, a ripple occurs in the common voltage due to a coupling phenomenon between the data lines and the common electrode. In the case where the polarity of the data voltages is positive, the ripple occurs in the common voltage in a positive direction with respect to the common voltage. In the case where the polarity of the data voltages is negative, the ripple occurs in the common voltage in a negative direction with respect to the common voltage. In this case, a difference in brightness between the (h+1)th row and the h-th and (h+2)th rows respectively disposed above and below (e.g., at upper and lower portions of) the (h+1)th row may be recognized, and as a result, a horizontal crosstalk may occur.

In the present exemplary embodiment, each of the pixels PX arranged in the same row is alternately applied with the positive (+) and negative (−) data voltages. Therefore, the sum of the positive polarities of the data voltages applied to the pixels PX arranged in the same row is set off against (e.g., balanced by) the sum of the negative polarities of the data voltages applied to the pixels PX arranged in the same row, and thus the ripple does not occur in the common voltage. As a result, the horizontal crosstalk may be prevented or substantially prevented from occurring in the display apparatus 100 according to the present exemplary embodiment.

The first direction DR1 includes a left direction and a right direction, and the second direction DR2 includes an upper direction and a lower direction. Hereinafter, a direction that passes through an intersection of the first and second directions DR1 and DR2, and passes between the upper direction of the first direction DR1 and the right direction of the second direction DR2 and between the lower direction of the first direction DR1 and the left direction of the second direction DR2, is referred to as a first diagonal direction DDR1. A direction that passes through the intersection of the first and second directions DR1 and DR2, and passes between the upper direction of the first direction DR1 and the left direction of the second direction DR2 and between the lower direction of the first direction DR1 and the right direction of the second direction DR2, is referred to as a second diagonal direction DDR2.

The pixels PX include a plurality of red pixel diagonal groups RDG, a plurality of green pixel diagonal groups GDG, a plurality of blue pixel diagonal groups BDG, and a plurality of white pixel diagonal groups WDG.

The red pixel diagonal groups RDG are referred to as first color pixel diagonal groups, the green pixel diagonal groups GDG are referred to as second color pixel diagonal groups, the blue pixel diagonal groups BDG are referred to as third color pixel diagonal groups, and the white pixel diagonal groups WDG are referred to as fourth color pixel diagonal groups.

Hereinafter, for the convenience of explanation, configurations of one red pixel diagonal group RDG, one green pixel diagonal group GDG, one blue pixel diagonal group BDG, and one white pixel diagonal group WDG shown in FIG. 4 will be described in further detail.

The red pixel diagonal group RDG includes the red pixels R arranged adjacent to each other in the first diagonal direction DDR1. For instance, the red pixels R included in the red pixel diagonal group RDG are respectively disposed at positions such that column indices of consecutive positions decrease by two when a row index increase by one.

The red pixels R of the red pixel diagonal group RDG receive the data voltages having the same polarity. For instance, the red pixels R of the red pixel diagonal group RDG receive the positive (+) data voltages.

The green pixel diagonal group GDG includes the green pixels G arranged adjacent to each other in the first diagonal direction DDR1. For instance, the green pixels G included in the green pixel diagonal group GDG are respectively disposed at positions such that the column indices of consecutive positions decrease by two when the row indices increase by one.

The green pixels G of the green pixel diagonal group GDG receive the data voltages having the same polarity. In addition, the green and red pixel diagonal groups GDG and RDG adjacent to each other receive the data voltage having opposite polarities to each other. Therefore, the green pixels G of the green pixel diagonal group GDG receive the negative (−) data voltages.

The blue pixel diagonal group BDG includes the blue pixels B arranged adjacent to each other in the second diagonal direction DDR2. For instance, the blue pixels B included in the blue pixel diagonal group BDG are respectively disposed at positions such that the column indices of consecutive positions increase by two when the row indices increase by one.

The blue pixels B of the blue pixel diagonal group BDG receive the data voltages having the same polarity. For instance, the blue pixels B of the blue pixel diagonal group BDG receive the negative (−) data voltages.

The white pixel diagonal group WDG includes the white pixels W arranged adjacent to each other in the second diagonal direction DDR2. For instance, the white pixels W included in the white pixel diagonal group WDG are respectively disposed at positions such that the column indices of consecutive positions increase by two when the row indices increase by one.

The white pixels W of the white pixel diagonal group WDG receive the data voltages having the same polarity. In addition, the white and blue pixel diagonal groups WDG and BDG adjacent to each other receive the data voltage having opposite polarities to each other. Therefore, the white pixels W of the white pixel diagonal group WDG receive the positive (+) data voltages.

The polarities of the data voltages applied to the white pixel diagonal groups WDG adjacent to each other are opposite to each other. For instance, the white pixel diagonal group WDG including the white pixels w+ arranged between a position of the first row and the fourth column and a position of the fourth row and the tenth column along the second diagonal direction DDR2 receive the positive (+) data voltages, and the white pixel diagonal group WDG including the white pixels w− arranged between a position of the first row and the eighth column and a position of the fourth row and the fourteenth column along the second diagonal direction DDR2 receive the negative (−) data voltages.

Similarly, the polarities of the data voltages applied to the blue pixel diagonal groups BDG adjacent to each other are opposite to each other, the polarities of the data voltages applied to the red pixel diagonal groups RDG adjacent to each other are opposite to each other, and the polarities of the data voltages applied to the green pixel diagonal groups GDG adjacent to each other are opposite to each other.

In general, the white and green colors are relatively sensitively perceived by human eyes, and the red and blue are relatively less sensitive to human eyes. In the case where the pixels PX arranged in the first column and having the same color receive the data voltages having the same polarity and the pixels PX arranged in the second column adjacent to the first column and having the same color receive the data voltages having the polarity different from that of the data voltages applied to the pixels PX arranged in the first column, a moving line-stain phenomenon occurs.

For instance, in the case wherein the red pixels R arranged in the first column receive the positive data voltage and the red pixels R arranged in the second column adjacent to the first column receive the negative data voltage, the brightness difference occurs between the red pixels R arranged in the first column and the red pixels R arranged in the second column due to the ripple of the common voltage, and thus a stripe pattern may be perceived in the column direction. When the present frame period proceeds to the next frame period, the polarity of the data voltages is inverted, and the stripe pattern may seem to move to the second direction DR2. The phenomenon in which the stripe pattern moves is called the moving line-stain phenomenon.

In the present exemplary embodiment, the red pixels R of the red pixel diagonal group RDG receive the data voltages having the same polarity, and the red pixel diagonal groups RDG adjacent to each other receive the data voltages having opposite polarities to each other. In addition, the blue pixels B of the blue pixel diagonal group BDG receive the data voltages having the same polarity, and the blue pixel diagonal groups BDG adjacent to each other receive the data voltages having opposite polarities to each other. Thus, a red stripe pattern and a blue stripe pattern may occur.

A direction in which the red pixels R of the red pixel diagonal group RDG are arranged and a direction in which the blue pixels B of the blue pixel diagonal group BDG are arranged are set to cross each other. A direction in which the green pixels G of the green pixel diagonal group GDG are arranged and a direction in which the white pixels W of the white pixel diagonal group WDG are arranged are set to cross each other.

In the case where the direction in which the red pixels R of the red pixel diagonal group RDG are arranged and the direction in which the blue pixels B of the blue pixel diagonal group BDG are arranged are different from each other, the red stripe pattern is set off by (e.g., not aligned with) the blue stripe pattern, so that a recognition rate of the red and blue stripe patterns is reduced. That is, in the case where the red and blue colors are simultaneously or concurrently displayed on the display panel 110, the red and blue stripe patterns may be prevented or substantially prevented from being recognized because the red and blue stripe patterns are respectively disposed at the first and second diagonal directions DDR1 and DDR2 crossing each other. Because the stripe pattern is prevented or substantially prevented from being recognized, the moving line-stain phenomenon caused by the stripe pattern may be prevented or substantially prevented from occurring.

In addition, because the direction in which the green pixels G of the green pixel diagonal group GDG are arranged and the direction in which the white pixels W of the white pixel diagonal group WDG are arranged are different from each other, the green stripe pattern is set off by (e.g., not aligned with) the white stripe pattern, so that a recognition rate of the green and white stripe patterns is reduced. That is, in the case where the green and white colors are simultaneously or concurrently displayed on the display panel 110, the green and white stripe patterns may be prevented or substantially prevented from being recognized because the green and white stripe patterns are respectively disposed at the first and second diagonal directions DDR1 and DDR2 crossing each other.

Consequently, the display apparatus 100 prevents or substantially prevents the occurrence of the horizontal crosstalk phenomenon and/or the moving line-stain phenomenon, and thus the display quality of the display apparatus 100 is improved.

Figure 5:
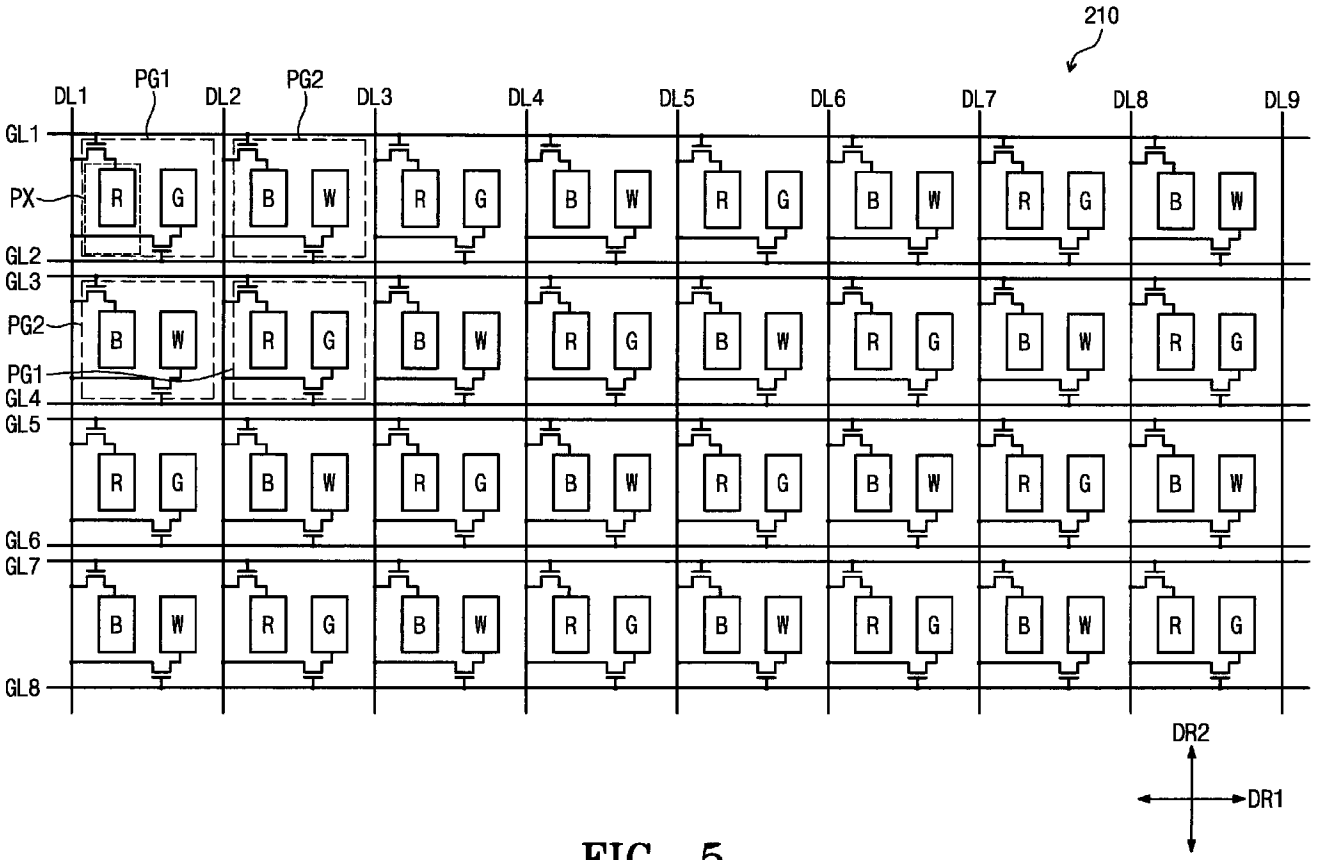
FIG. 5 is a plan view showing a portion of a display panel according to another exemplary embodiment of the present disclosure.

FIG. 5 is a plan view showing a portion of a display panel 210 according to another exemplary embodiment of the present disclosure.

A display apparatus according to the present exemplary embodiment has the same structure and function as those of the display apparatus 100 except for the display panel 210. Hereinafter, different features between the display panel 210 shown in FIG. 5 and the display panel 110 shown in FIG. 3 will be described in further detail.

Referring to FIG. 5, the pixels PX are disposed between the data lines adjacent to each other in the unit of two columns, disposed between odd- and even-numbered gate lines adjacent to each other in the unit of one row, and connected to the data lines DL1 to DL9 and the gate lines GL1 to GL8. The pixels PX are grouped into first and second pixel groups PG1 and PG2 arranged in the second direction DR2 in the unit of two columns.

The pixels arranged in k-th and (k+1)th columns disposed between j-th and (j+1)th data lines are connected to the j-th data line. For instance, in the case where each of the j and k is 1, the pixels PX arranged in the first and second columns disposed between the first and second data lines DL1 and DL2 are connected to the first data line DL1.

Among the pixels arranged in an h-th row disposed between g-th and (g+1)th gate lines, the pixels arranged in the k-th row are connected to the g-th gate line, and the pixels arranged in the (k+1)th row are connected to the (g+1)th gate line. The index g is an odd number among natural numbers.

For instance, in the case where each of g, k, and h is 1, among the pixels PX arranged in the first row disposed between the first and second gate lines GL1 and GL2, the red pixels R arranged in the first row are connected to the first gate line GL1, and the green pixels G arranged in the second column are connected to the second gate line GL2.

Figure 6:
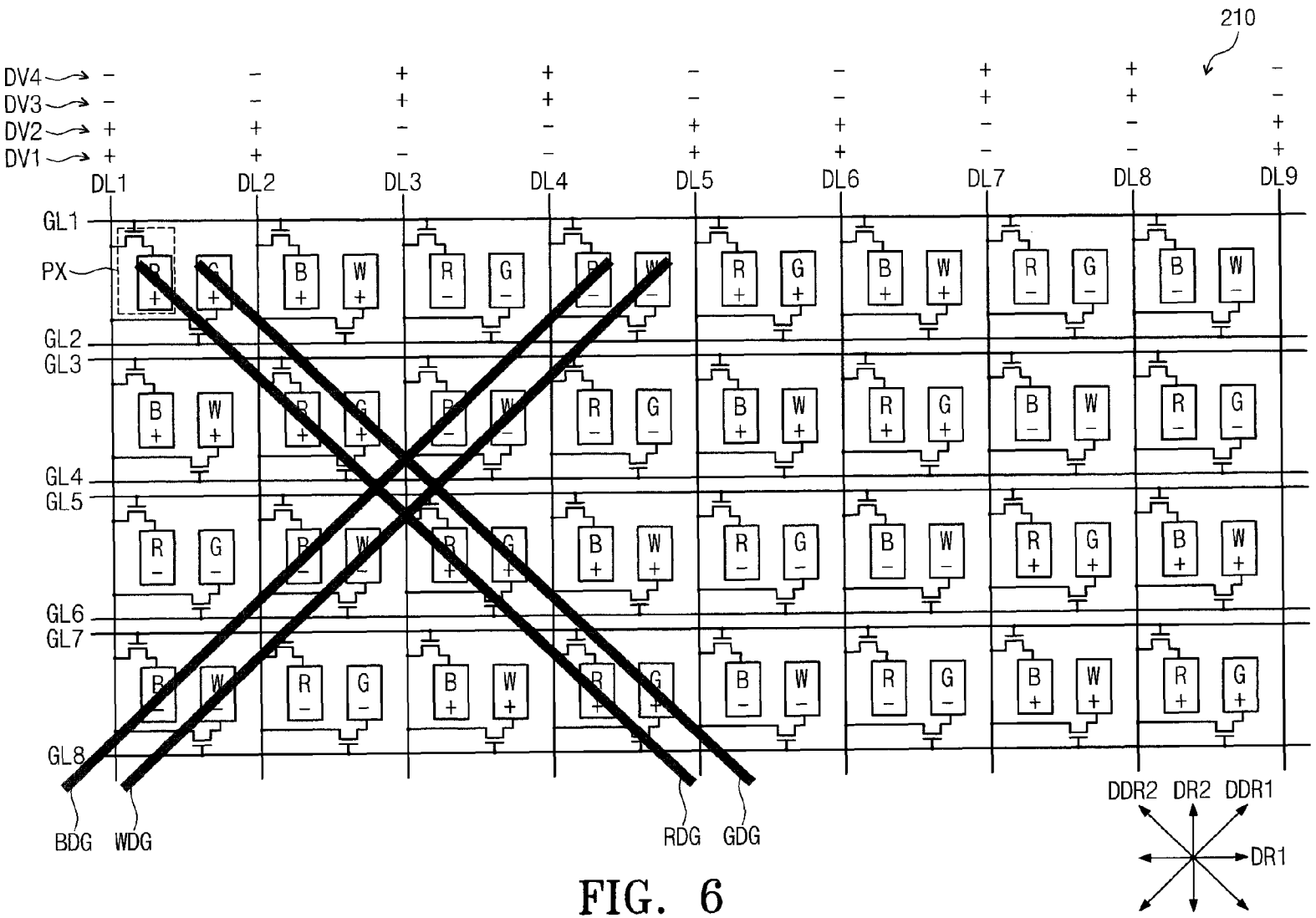
FIG. 6 is a view showing polarities of data voltages applied to data lines shown in FIG. 5 and polarities of pixels applied with the data voltages.

FIG. 6 is a view showing polarities of data voltages applied to data lines shown in FIG. 5 and polarities of pixels applied with the data voltages.

Referring to FIG. 6, the polarity of the data voltages is inverted every two columns in one frame period. For instance, as shown in FIG. 6, the data voltages DV1 and DV2 repeatedly having the polarities of +, +, −, −, +, +, −, and − are applied to the pixels PX arranged in the first and second rows through the data lines DL1 to DL9 during the present frame period, and the data voltages DV3 and DV4 repeatedly having the polarities of −, −, +, +, −, −, +, and + are applied to the pixels PX arranged in the third and fourth rows through the data lines DL1 to DL9 during the present frame period.

The polarity of the data voltages applied to the pixels PX arranged in the h-th row is inverted every two data lines. For example, in the case where the index h is 1, among the data lines DL1 to DL9 connected to the pixels PX arranged in the first row, the positive (+) data voltages are applied to the first, second, fifth, sixth, and ninth data lines, and the negative (−) data voltages are applied to the third, fourth, seventh, and eighth data lines.

The red pixel diagonal group RDG includes a plurality of red pixels R arranged adjacent to each other in the second diagonal direction DDR2. The red pixels R+ included in the red pixel diagonal group RDG receive the data voltages having the same polarity. The red pixel diagonal groups RDG adjacent to each other are applied with the data voltages having opposite polarities to each other.

The green pixel diagonal group GDG includes a plurality of green pixels G arranged adjacent to each other in the second diagonal direction DDR2. The green pixels G+ included in the green pixel diagonal group GDG receive the data voltages having the same polarity. The green pixel diagonal groups GDG adjacent to each other are applied with the data voltages having opposite polarities to each other.

The red and green pixel diagonal groups RDG and GDG adjacent to each other receive the data voltages having the same polarity. For instance, the red pixels R+ of the red pixel diagonal group RDG and the green pixels G+ of the green pixel diagonal group GDG receive the positive (+) data voltages as shown in FIG. 6.

The blue pixel diagonal group BDG includes a plurality of blue pixels B arranged adjacent to each other in the first diagonal direction DDR1. The blue pixels B− included in the blue pixel diagonal group BDG receive the data voltages having the same polarity. The blue pixel diagonal groups BDG adjacent to each other are applied with the data voltages having opposite polarities to each other.

The white pixel diagonal group WDG includes a plurality of white pixels W arranged adjacent to each other in the first diagonal direction DDR1. The white pixels W− included in the white pixel diagonal group WDG receive the data voltages having the same polarity. The white pixel diagonal groups WDG adjacent to each other are applied with the data voltages having opposite polarities to each other.

The blue and white pixel diagonal groups BDG and WDG adjacent to each other receive the data voltages having the same polarity. For instance, the blue pixels B− of the blue pixel diagonal group BDG and the white pixels W− of the white pixel diagonal group WDG receive the negative (−) data voltages as shown in FIG. 6.

As shown in FIG. 6, the positive (+) and negative (−) data voltages are alternately applied to each of the pixels PX arranged in the same row. Thus, the horizontal crosstalk phenomenon may be prevented or substantially prevented from occurring.

A direction in which the red pixels R of the red pixel diagonal group RDG are arranged and a direction in which the blue pixels B of the blue pixel diagonal group BDG are arranged are respectively set to be the first and second diagonal directions DDR1 and DDR2 different from each other. A direction in which the green pixels G of the green pixel diagonal group GDG are arranged and a direction in which the white pixels W of the white pixel diagonal group WDG are arranged are respectively set to be the first and second diagonal directions DDR1 and DDR2 different from each other. Accordingly, red, blue, green, and white stripe patterns may be prevented or substantially prevented from being perceived.

Consequently, the display apparatus according to the present exemplary embodiment prevents or substantially prevents the occurrence of the horizontal crosstalk phenomenon and the moving line-stain phenomenon, and thus the display quality of the display apparatus is improved.

Figure 7:
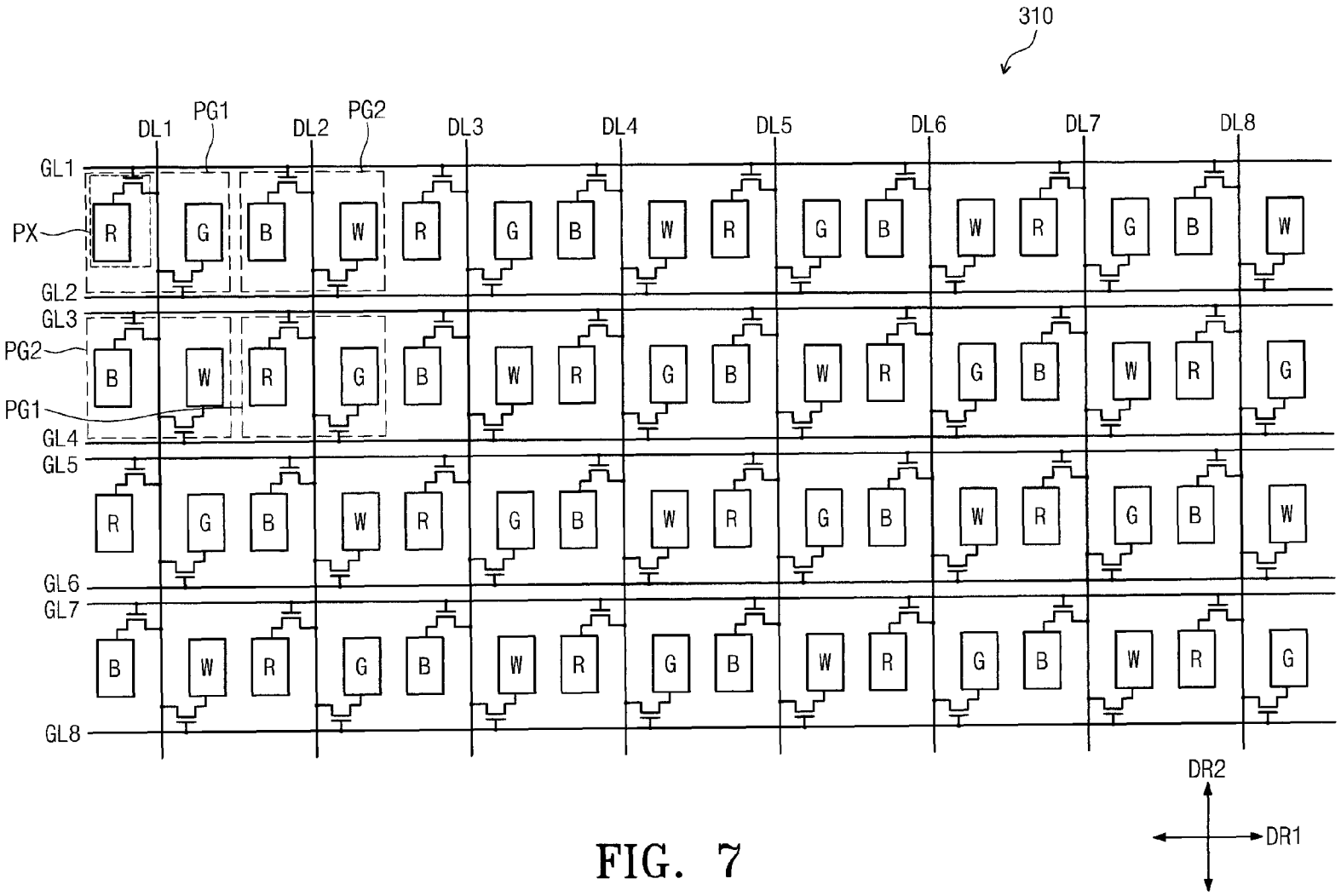
FIG. 7 is a plan view showing a portion of a display panel according to another exemplary embodiment of the present disclosure.

FIG. 7 is a plan view showing a portion of a display panel 310 according to another exemplary embodiment of the present disclosure.

A display apparatus according to the present exemplary embodiment has the same structure and function as those of the display apparatus 100 except for the display panel 310. Hereinafter, different features between the display panel 310 shown in FIG. 7 and the display panel 110 shown in FIG. 3 will be described in further detail.

Referring to FIG. 7, a j-th data line is disposed between the pixels PX arranged in an f-th column and the pixels PX arranged in a (f+1)th column, and the pixels PX arranged in the f-th column and the pixels PX arranged in the (f+1)th column are connected to the j-th data line. In the present exemplary embodiment, the index f is an odd number among natural numbers. For instance, in the case where each of the indices f and j is 1, the first data line DL1 is disposed between the first and second columns, and the pixels PX arranged in the first and second columns are connected to the first data line DL1. The f-th column and the (f+1)th column, which are adjacent to each other, are defined as first and second pixel groups PG1 and PG2 arranged in the second direction DR2.

Among the pixels arranged in the h-th row disposed between a g-th gate line and a (g+1)th gate line, the pixels arranged in the f-th column are connected to the g-th gate line, and the pixels arranged in the (f+1)th column are connected to the (g+1)th gate line.

Figure 8:
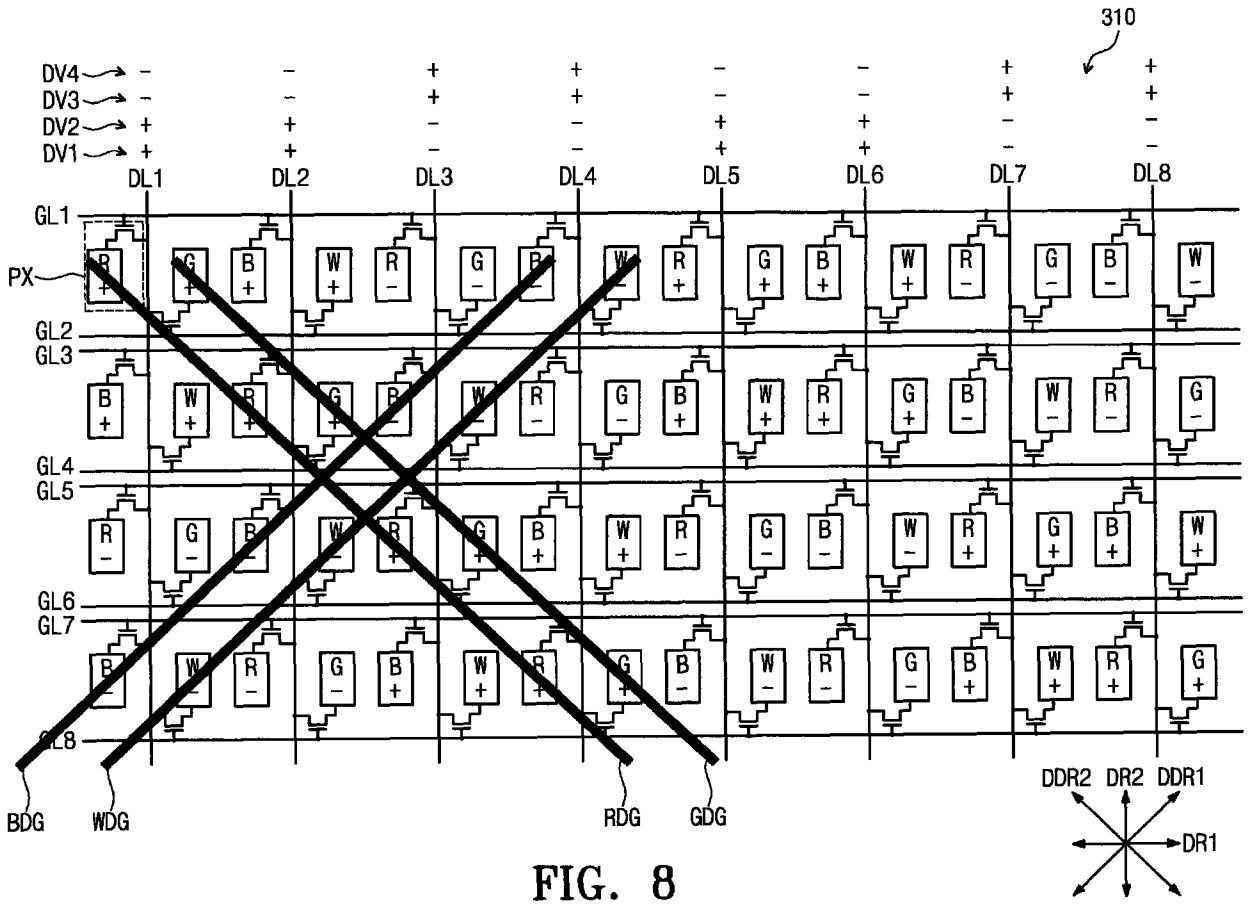
FIG. 8 is a view showing polarities of data voltages applied to data lines shown in FIG. 7 and polarities of pixels applied with the data voltages.

FIG. 8 is a view showing polarities of data voltages applied to data lines shown in FIG. 7 and polarities of pixels applied with the data voltages.

Referring to FIG. 8, the polarities of the data voltages applied to the pixels PX are substantially the same as those of the data voltages shown in FIG. 6. In addition, red, green, blue, and white pixel diagonal groups RDG, GDG, BDG, and WDG have substantially the same configurations as those of the red, green, blue, and white pixel diagonal groups RDG, GDG, BDG, and WDG shown in FIG. 6, and thus details thereof, may not be repeated.

As shown in FIG. 8, the positive (+) and negative (−) data voltages are alternately applied to each of the pixels PX arranged in the same row. Thus, the horizontal crosstalk phenomenon may be prevented or substantially prevented from occurring.

A direction in which the red pixels R of the red pixel diagonal group RDG are arranged and a direction in which the blue pixels B of the blue pixel diagonal group BDG are arranged are different from each other, and a direction in which the green pixels G of the green pixel diagonal group GDG are arranged and a direction in which the white pixels W of the white pixel diagonal group WDG are different from each other. Accordingly, red, blue, green, and white stripe patterns may be prevented or substantially prevented from being perceived.

Consequently, the display apparatus according to the present exemplary embodiment prevents or substantially prevents the occurrence of the horizontal crosstalk phenomenon and/or the moving line-stain phenomenon, and thus the display quality of the display apparatus is improved.

It will be understood that, although the terms "first", "second", "third", etc., may be used herein to describe various elements, components, regions, layers and/or sections, these elements, components, regions, layers and/or sections should not be limited by these terms. These terms are used to distinguish one element, component, region, layer or section from another element, component, region, layer or section.

Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "include," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the inventive concept." Also, the term "exemplary" is intended to refer to an example or illustration.

It will be understood that when an element or layer is referred to as being "on", "connected to", "coupled to", or "adjacent" another element or layer, it can be directly on, connected to, coupled to, or adjacent the other element or layer, or one or more intervening elements or layers may be present. When an element or layer is referred to as being "directly on," "directly connected to", "directly coupled to", or "immediately adjacent" another element or layer, there are no intervening elements or layers present.

As used herein, the term "substantially," "about," and similar terms are used as terms of approximation and not as terms of degree, and are intended to account for the inherent variations in measured or calculated values that would be recognized by those of ordinary skill in the art.

As used herein, the terms "use," "using," and "used" may be considered synonymous with the terms "utilize," "utilizing," and "utilized," respectively.

The display apparatus and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the display apparatus may be formed on one integrated circuit (IC) chip or on separate IC chips. Further, the various components of the display apparatus may be implemented on a flexible printed circuit film, a tape carrier package (TCP), a printed circuit board (PCB), or formed on a same substrate. Further, the various components of the display apparatus may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the scope of the exemplary embodiments of the present invention.

Although the exemplary embodiments of the present invention have been described, it is understood that the present invention should not be limited to these exemplary embodiments but various changes and modifications can be made by one ordinary skilled in the art within the spirit and scope of the present invention as defined by the following claims and equivalents thereof.

What is claimed is:

1. A display apparatus comprising:

a plurality of gate lines extending along a first direction;

a plurality of data lines extending along a second direction crossing the first direction; and a plurality of pixels connected to the plurality of gate lines and the plurality of data lines, wherein, among pixels of the plurality of pixels arranged in a k-th column and a (k+1)th column between a j-th data line of the plurality of data lines and a (j+1)th data line of the plurality of data lines, the pixels arranged in the k-th column are connected to one of the j-th and (j+1)th data lines, the pixels arranged in the (k+1)th column are connected to an other one of the j-th and (j+1)th data lines, the pixels arranged in the k-th and (k+1)th columns are alternately connected to the j-th and (j+1)th data lines in a unit of two pixels, each of j and k is a natural number, a connection configuration between the (j+1)th data line and (j+2)th data line of the plurality of data lines and pixels of the plurality of pixels arranged in (k+2)th and (k+3)th columns between the (j+1)th and (j+2)th data lines is substantially the same as a connection configuration between pixels of the plurality of pixels arranged in the k-th and (k+1)th columns and the j-th and (j+1)th data lines, and a connection configuration between the (j+2)th data line and (j+3)th data line of the data lines and pixels of the plurality of pixels arranged in (k+4)th and (k+5)th columns between the (j+2)th and (j+3)th data lines and a connection configuration between the (j+3)th data line and (j+4)th data line of the data lines and pixels of the plurality of pixels arranged in (k+6)th and (k+7)th columns between the (j+3)th and (j+4)th data lines is opposite to a connection configuration between the pixels arranged in the k-th and (k+1)th columns and the j-th and (j+1)th data lines.

2. The display apparatus of claim 1, wherein, among pixels of the plurality of pixels arranged in the k-th column, pixels of the plurality of pixels arranged in h-th and (h+1)th rows are connected to the j-th data line, and pixels of the plurality of pixels arranged in (h+2)th and (h+3)th rows are connected to the (j+1)th data line, h being a natural number, and wherein among the pixels arranged in the (k+1)th column, pixels of the plurality of pixels arranged in the h-th and (h+1)th rows are connected to the (j+1)th data line, and pixels of the plurality of pixels arranged in the (h+2)th and (h+3)th rows are connected to the j-th data line.

3. The display apparatus of claim 1, wherein the pixels are between odd- and even-numbered gate lines of the plurality of gate lines adjacent to each other in a unit of one row, pixels of the plurality of pixels arranged in a same row are alternately connected to the odd- and even-numbered gate lines in the unit of 8×l pixels, and I is a natural number.

4. The display apparatus of claim 3, wherein a connection configuration between i-th and (i+1)th gate lines of the plurality of gate lines and pixels of the plurality of pixels arranged in a h-th row between the i-th and (i+1)th gate lines is substantially the same as a connection configuration between (i+2)th and (i+3)th gate lines of the plurality of gate lines and pixels of the plurality of pixels arranged in a (h+1)th row between the (i+2)th and (i+3)th gate lines, and each of h and i is a natural number.

5. The display apparatus of claim 4, wherein earlier eight pixels arranged in the h-th row are sequentially connected to the (1+1)th, i-th, (1+1)th, (i+1)th, (i+1)th, i-th, (i+1)th, and i-th gate lines.

6. The display apparatus of claim 4, wherein a connection configuration between (i+4)th and (i+5)th gate lines of the plurality of gate lines and pixels of the plurality of pixels arranged in a (h+2)th row between the (i+4)th and (i+5)th gate lines is substantially the same as a connection configuration between (i+6)th and (i+7)th gate lines of the plurality of gate lines and pixels of the plurality of pixels arranged in a (h+3)th row between the (i+6)th and (i+7)th gate lines.

7. The display apparatus of claim 6, wherein earlier eight pixels arranged in the (h+2)th row are sequentially connected to the (i+5)th, (i+4)th, (i+5)th, (i+4)th, (i+4)th, (i+5)th, (i+4)th, and (i+4)th gate lines.

8. The display apparatus of claim 1, wherein a positive data voltage and a negative data voltage are alternately applied to the plurality of data lines during one frame period, and polarities of the data voltages are inverted every frame period.

9. The display apparatus of claim 1, wherein the plurality of pixels comprise:

a plurality of first pixel groups, each of the plurality of first pixel groups comprising a first color pixel and a second color pixel; and a plurality of second pixel groups, each of the plurality of second pixel groups comprising a third color pixel and a fourth color pixel, and the first pixel groups are alternately arranged with the second pixel groups in the first and second directions.

10. The display apparatus of claim 9, wherein the first and second pixel groups arranged in the second direction are between ones of the plurality of data lines adjacent to each other.

11. The display apparatus of claim 9, wherein the first and second color pixels and the third and fourth color pixels are arranged in the first direction.

12. The display apparatus of claim 9, wherein the first, second, third, and fourth colors comprise red, green, blue, and white colors, respectively.

13. The display apparatus of claim 9, wherein the first, second, third, and fourth colors comprise blue, white, red, and green colors, respectively.

14. The display apparatus of claim 9, wherein the first direction comprises an upper direction and a lower direction, the second direction comprises a left direction and a right direction, and the pixels comprise:

a plurality of first color pixel diagonal groups, each of the plurality of first color pixel diagonal groups comprising first color pixels arranged adjacent to each other in a first diagonal direction passing through an intersection of the first and second directions and passing between the upper direction of the first direction and the right direction of the second direction and between the lower direction of the first direction and the left direction of the second direction;

a plurality of second color pixel diagonal groups, each of the plurality of second color pixel diagonal groups comprising second color pixels arranged adjacent to each other in the first diagonal direction;

a plurality of third color pixel diagonal groups, each of the plurality of third color pixel diagonal groups comprising third color pixels arranged adjacent to each other in a second diagonal direction passing through the intersection of the first and second directions and passing between the upper direction of the first direction and the left direction of the second direction and between the lower direction of the first direction and the right direction of the second direction; and a plurality of fourth color pixel diagonal groups, each of the plurality of fourth color pixel diagonal groups comprising fourth color pixels arranged adjacent to each other in the second diagonal direction.

15. The display apparatus of claim 14, wherein the first color pixels of each of the first color pixel diagonal groups are configured to receive data voltages having the same polarity, the second color pixels of each of the second color pixel diagonal groups are configured to receive the data voltages having the same polarity, the third color pixels of each of the third color pixel diagonal groups are configured to receive the data voltages having the same polarity, and the fourth color pixels of each of the fourth color pixel diagonal groups are configured to receive the data voltages having the same polarity.

16. The display apparatus of claim 15, wherein the first and second color pixel diagonal groups adjacent to each other are configured to receive data voltages having opposite polarities to each other.

17. The display apparatus of claim 15, wherein the third and fourth color pixel diagonal groups adjacent to each other are configured to receive data voltages having opposite polarities to each other.

18. The display apparatus of claim 15, wherein the first color pixels adjacent to each other are configured to receive data voltages having opposite polarities to each other, the second color pixels adjacent to each other are configured to receive the data voltages having opposite polarities to each other, the third color pixels adjacent to each other are configured to receive the data voltages having opposite polarities to each other, and the fourth color pixels adjacent to each other are configured to receive the data voltages having opposite polarities to each other.

* * * * *